US006012406A

United States Patent [19]

Dudley et al.

[11] Patent Number: 6,012,406

[45] Date of Patent: Jan. 11, 2000

[54] PORTABLE SEISMIC VESSEL

[75] Inventors: Timothy A. Dudley, New Iberia, La.; Darrell F. VanMeter, Benton, Ky.; Jeff N. Mayville, Richmond, Tex.

[73] Assignee: Western Atlas International, Inc., Houston, Tex.

[21] Appl. No.: 09/093,175

[22] Filed: Jun. 8, 1998

[51] Int. Cl.[7] ..... B63B 3/02

[52] U.S. Cl. ..... 114/77 R; 114/254

[58] Field of Search ..... 114/65 R, 77 R, 114/74 R, 123, 292, 253, 254, 352

[56] References Cited

U.S. PATENT DOCUMENTS 2,731,741 1/1956 Kaufmann ..... 114/77 R
4,936,238 6/1990 Childress ..... 114/77 R
5,199,659 4/1993 Zibilich, Jr. ..... 114/254
5,479,869 1/1996 Coudon et al. ..... 114/77 R

*Primary Examiner*—Stephen Avila
*Attorney, Agent, or Firm*—Alan J. Atkinson

[57] ABSTRACT

A portable seismic vessel which is truck transportable to remote survey sites. The vessel is assembled with multiple self-contained, autonomous modules. Different modules provide crew quarters, dining facilities, propulsion, fuel and equipment storage. The vessel is capable of storing and deploying acoustic energy sources, seismic streamers, and recording equipment for processing seismic data. A unique ballast system accommodates structural flexing of the vessel. The vessel is uniquely suitable to efficiently access previously inaccessible survey sites and provides design flexibility in customizing the seismic vessel to unique operating requirements.

12 Claims, 2 Drawing Sheets

PORTABLE SEISMIC VESSEL

BACKGROUND OF THE INVENTION

The present invention relates to the field of marine seismic exploration. More particularly, the invention relates to a highly portable marine seismic vessel for accessing relatively inaccessible regions to deploy seismic streamers behind the vessel, and to collect geophysical data representing subsurface geologic formations.

Marine seismic vessels tow multiple seismic streamers through water to carry acoustic sensitive hydrophones. Acoustic energy sources such as air guns discharge energy pulses which travel downwardly into subsurface geologic formations underlying the water. Portions of the source energy are reflected upwardly by geologic structures and by the interfaces between adjacent formations. The acoustic signals detected by the hydrophones are converted into signals representing subsurface formation structures, and are recorded for data processing and display.

Marine seismic vessels require certain carrying capacity and space. Large arrays of multiple streamers up to several kilometers in length are towed behind seismic vessels to reduce the number of passes required by the vessel for the particular survey site. The streamers and combined streamer arrays are deployed and retrieved from the seismic vessel deck, requiring cable handling equipment and deck storage space. Work crews typically require sixteen members or more to handle multiple tasks, and the logistics of supporting crew members require vessel space.

The economic operation of seismic vessels depends on the number of days required for mobilization and demobilization. Because the nature of marine seismic exploration inherently covers large areas in remote regions, transport to the survey site significantly affects efficient utilization of a seismic vessel. Large seismic vessels capable of towing large streamer arrays are typically assigned to a particular geographic region having large water surfaces. However, large seismic vessels are not typically suited for Arctic regions having limited sailing seasons, or for regions having shallow water and multiple underwater obstructions. For seismic operations in the Beaufort Sea and other Arctic regions, water passage through the pack ice does not open every year. In heavy ice years, survey operations must be postponed until the next season or expensive icebreaking operations must be undertaken to provide passage. Even if a seismic vessel successfully passes through the ice flows to reach the survey site, the prospect of having the seismic vessel trapped by the next season's ice typically requires a conservative, abbreviated operating season. For Arctic seasons having a limited two or three month sailing season, the significance of each operating day is magnified.

If land masses and underwater obstructions prohibit operation of a large seismic vessel, shallow draft barges towed by a tug vessel can provide a floating base for conducting seismic operations. Such barges have limited deck space and do not provide crew quarters and other room essential to continuous operation of seismic operations. Accordingly, work crews commute between living quarters and the seismic barge, which exposes the crew to bad weather and other local hazards. In the Arctic and other extreme regions, fog, waves, floating ice, and other environmental hazards hinder crew travel.

Portable pontoon systems have been constructed to establish temporary bridges, docks, drilling platforms, and other floating bases to support equipment and other structural components. For example, U.S. Pat. No. 4,890,959 to Robishaw et al. (1990) disclosed a system for transporting ISO standard freight sized containers to a remote site and for assembling such containers into a structural base. U.S. Pat. No. 5,664,517 to Brydel et al. (1997) disclosed a pontoon connector system for permitting pontoon assembly under rough sea conditions.

Other systems provide assembled barge units designed for water transport. For example, U.S. Pat. No. 4,809,636 to Robishaw et al. (1989) and U.S. Pat. No. 4,928,616 to Robishaw et al. (1990) described a construction transportation system assembled with portable units formed as ISO standard freight containers. Specialized end units provided a rake surface for facilitating movement of the assembly through water. U.S. Pat. No. 5,203,271 to Chapman (1993) disclosed a shallow draft barge for operation in shallow water. U.S. Pat. No. 3,691,974 to Seiford et al. (1972) disclosed a portable barge system having modular pontoon units assembled with a locking system, and U.S. Pat. No. 3,983,830 to Morgan (1975) disclosed a modular barge having tensioned cables for assembling and securing individual barge units.

Other systems have been developed to provide rapid response vessels capable of immediate, emergency deployment. In U.S. Pat. No. 5,479,869 to Coudon et al. (1991), two oil spill recovery barges were each constructed with two pontoons assembled side-to-side. One barge carried a detachable propulsion thrust unit and a detachable crane, and the other towed barge provided storage capacity for collecting recovered hydrocarbons. Although each pontoon was dimensioned for overland truck transport, the assembled barge provided limited functional capabilities for removing oil from the water.

Existing seismic vessels represent significant vessels having large towage and equipment support capabilities, and are not deployable in many regions and water depths of seismic exploration interest. Towed barges do not provide the flexibility to support the multiple functions performed in large marine seismic surveys. There is, accordingly, a need for a seismic vessel capable of deployment in remote and otherwise inaccessible regions. The vessel should be easy to transport but be sufficiently large to support conventional marine seismic equipment.

SUMMARY OF THE INVENTION

The present invention provides a modular, portable seismic vessel for supporting marine seismic equipment. The vessel comprises a plurality of self-contained, autonomous modules, a connection means for retaining said modules in a configuration forming the seismic vessel, a propulsion means attached to at least one module for propelling the seismic vessel, a controller engaged with said propulsion means for controlling movement of the vessel through the water, and handling means for engaging the marine seismic equipment.

In different embodiments of the invention, a ballast system accommodates flexure and weight redistribution of the seismic vessel, and the modules can comprise crew quarters and other use specific modules. The seismic equipment can comprise acoustic energy sources and hydrophone carrying streamers and seismic data recording and processing equipment. The individual modules can be sized to be truck transportable and can include sufficient propulsion means to provide in-water transport of vessel sections before final assembly.

DESCRIPTION OF THE PREFERRED EMBODIMENTS

The present invention provides a portable seismic vessel capable of rapid delivery and deployment in previously inaccessible regions. The modular vessel sections can be separately transported to the survey site and can be assembled to form the seismic vessel.

Figure 1:
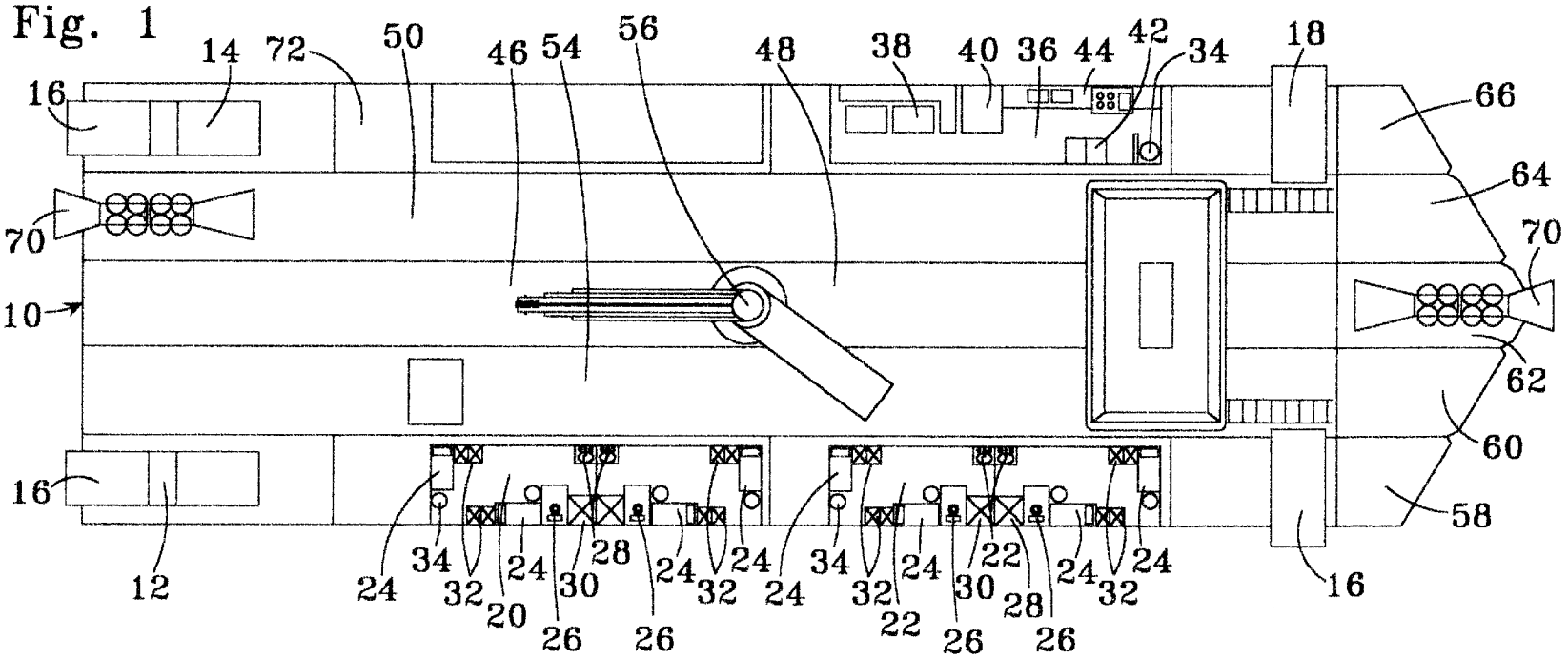
FIG. 1 illustrates a plan view for one embodiment of a portable seismic vessel.

FIG. 1 illustrates a plan view for one embodiment of the invention wherein vessel 10 is assembled from a plurality of separate, autonomous modules. As used herein, the term "plurality" means four or more. The term "autonomous" means that each module defines an independent unit capable of providing separate functional operation or support to other portions of vessel 10. Although each module can be separately watertight and bulkheaded to furnish independent water sealed capabilities, such feature is not essential to the successful operation of vessel 10 or to classification of a module as autonomous. Various modules can comprise vans for dry storage, buoyancy, equipment room, fuel storage, repair shop, control room, and other uses as more thoroughly described below.

Modules 12 and 14 define propulsion units having stem mounted thrusters 16 for independent steering control and propulsion of vessel 10. Steering functions can be provided by the selective integrated control of multiple thrusters 16, by components within each thruster 16 for redirecting the propulsion forces, or by independent steering controls engaged with thrusters 16. Module 18 can incorporate one or more bow side-mounted thrusters 16 for facilitating vessel 10 steering. Modules 20 and 22 provide crew quarters for housing off-duty vessel crew members. Modules 20 and 22 permit on-vessel occupancy to facilitate continuous seismic operations and to limit the need for shuttling crew to on-shore facilities. This feature of the invention enhances crew safety by limiting exposure to hazardous weather and environmental factors, whether in tropical or Arctic regions. Modules 20 and 22 can include sleeping facilities 24, restrooms 26, washroom facilities 28, clothes washers and dryers 30, lockers 32, and tables 34. Module 36 provides dining facilities having seating 38, storage 40, refrigeration equipment 42, and cooking equipment 44.

Figure 2:
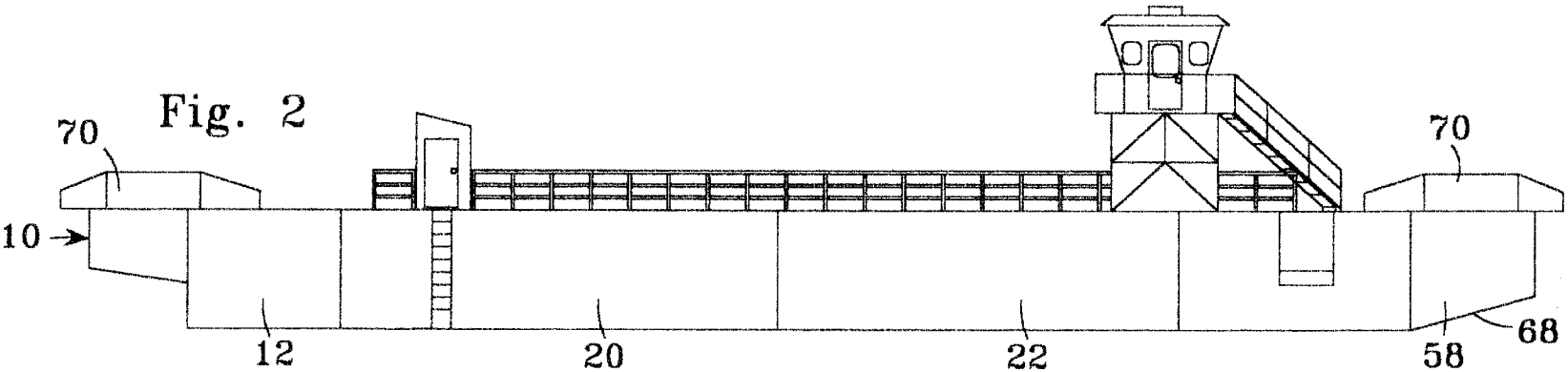
FIG. 2 illustrates an elevation view of a portable seismic vessel.

Module 46 provides fuel storage capability for vessel 10, and module 48 provides potable water storage. Modules 50, 52 and 54 are connected to form a central base for vessel 10 and provide deck space for equipment such as cable and streamer handling equipment 56. Special modules 58, 60, 62, 64 and 66 are collectively shaped in a wedge shaped prow to form the bow of vessel 10 and have a rake surface 68 as shown in FIG. 2 to facilitate transport of vessel 10 through water. Cable handling means such as equipment 70 can be attached to the bow and stem of vessel 10 as illustrated to facilitate cable or streamer handling from either end of vessel 10. Module 72 provides storage capacity suitable for equipment repair or other operations.

Vessel 10 provides a base for supporting seismic equipment. As used herein, the term "support" means the physical transport of equipment by a floating base, and also includes the provision of a base proximate to or engaged with equipment through wireless transmission, as a staging area for air supply transport, and other means to aid or facilitate equipment operation. "Support" can also include conventional seismic exploration operations for towing air guns and other seismic energy sources, in-water streamer repair, supply tender operations, work crew shift changes, and deployment and retrieval of streamer seismic arrays. As used herein, "handling means" includes any equipment or device or apparatus which supports or is engaged with marine seismic equipment. As representative examples, handling means can comprise streamer deployment devices, air compressors, positioning devices, data recorders, computers, signal generators, repair boats, safety systems, fuel storage and pumps, and other devices. Other uses and functions not listed herein are within the scope of the invention. Generator module 74 can contain compressors for supplying compressed air to air guns (not shown) towed behind vessel 10.

Figure 3:
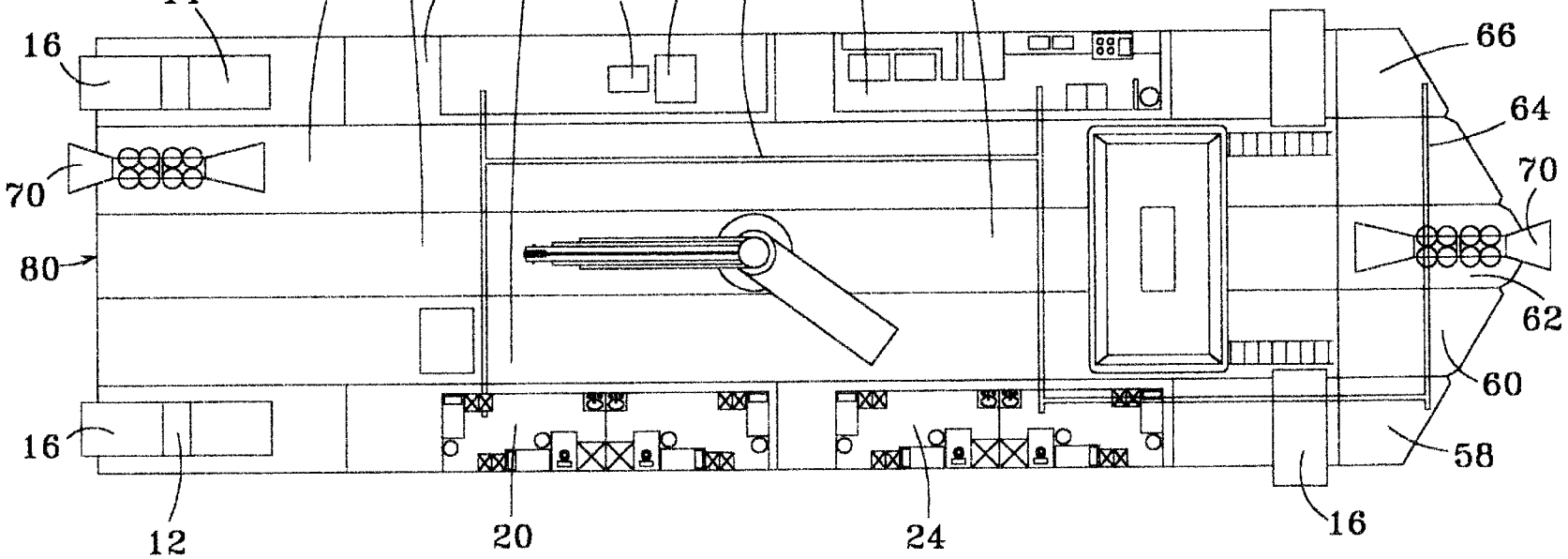
FIG. 3 illustrates another embodiment of a portable seismic vessel.

FIG. 3 illustrates another embodiment of the invention wherein vessel 80 has similar modules as shown for FIG. 1 except that module 82 is substituted for module 72. Module 82 contains recording equipment 84 and processing equipment 86 which is engaged with hydrophones carried by marine seismic streamers, bottom cables, or other sensing units (not shown) deployed from vessel 80. Such equipment can comprise tape drives, computers for compressing and processing and displaying seismic data, and communication equipment for transmitting data to other recording and processing facilities. The embodiments shown in FIGS. 1 and 3 are specifically adapted to providing one vessel for generating acoustic source energy and another vessel to detect and record the reflected seismic data, however, many other configurations and functional uses of modules can be made to accomplish the structure and function of the invention.

Vessel 80 includes ballast system 88 which redistributes water or other ballast material from one portion of vessel 80 to another. Ballast system 88 is formed with pumps, interconnected piping and ballast storage compartments which facilitates addition or deletion of individual modules from vessel 80. In a preferred embodiment of the invention, ballast system 88 is substantially located externally of the modules to facilitate hook-up of the components and modification of the vessel configuration. Due to flexure of vessel 80 as individual modules are impacted by different environmental forces, ballast system 88 preferably is sufficiently flexible to accommodate for such movement.

The self-contained modules can be constructed in different ways from different materials, and the specific design and fabrication of such modules is not essential to the functional operation of the present invention. One suitable form of module is manufactured as the Flexifloat System, provided by Robishaw Engineering of Houston, Tex. Such system comprises modular, interlocking steel barges and attachments which are highly portable and are designed for road transport by standard highway trucks and trailers. The individual modules can be off-loaded from trucks can be quickly connected into larger assemblies of various shapes and sizes. Each module is welded steel construction and is heavily reinforced to withstand repeated use under extreme load conditions. The modules are sealed and watertight, and can be connected side-to-side, end-to-end, or end-to-side. Conventional attachments can comprise drive on/off ramps, raked bow and stern sections, self-elevating attachments, and anchoring and mooring devices.

The Robishaw Series S-50 equipment is designed for the range of 75 to 200 ton loads, and each module typically has a length of 40 feet and a width of 10 feet. Typical module weight is 25,600 pounds, with a rated load capacity of 27 tons at 3.3 foot draft. The horizontal lock spacing is 60 inches, and the vertical lock spacing is 53.5 inches. The lock strength of the connectors is 45 tons at 65% yield.

Independent movement of the individual modules forming vessel 10 causes flexure of vessel 10 as vessel 10 is subjected to wind, waves, currents, and ice loading, and to the drag induced by seismic equipment such as towed seismic streamers. Vessel 10 uniquely adjusts to accommodate such forces, and is virtually unsinkable because of the independent buoyancy capabilities provided by each module. Damage to one module caused by ice or another water hazard is easily repaired by removing the damaged module for repair, or by replacing the damaged module. This feature of the invention significantly reduces economic risk damage caused by vessel repair downtime. Flexure of vessel 10 between individual modules provides unique vessel capabilities in handling different sea conditions, and the unique vessel design also facilitates shallow draft operation without loss of marine stability.

A single, fully integrated vessel can be assembled to tow seismic energy sources and to tow the hydrophone carrying streamers (or to deploy bottom cables) necessary to detect seismic energy reflected from subsurface geologic formations and interfaces. Alternatively, vessel 10 and vessel 80 can be towed simultaneously to provide different, complementary operating functions. The unique, modular configuration of the vessels provides significant flexibility in transporting the vessels into previously inaccessible regions. For example, vessel 10 can be assembled into two separate sections divided along the vessel beam so that the total vessel width of each section is halved, yet each section is propelled by a separate thruster 16. This capability permits marine transport of the vessel sections through rivers, narrow bay channels, and underwater hazards previously inaccessible to large seismic vessels. Although each vessel section can provide its own power, each section could also be towed to the final survey site for reassembly.

Although the sail time from the Gulf of Mexico to the Beaufort Sea is typically two months, the present invention requires truck travel of ten to twelve days between the same origin and destination. For this reason, the present invention provides unique mobilization efficiency not capable with conventional seismic vessels. This mobility facilitates year-round use of a seismic vessel. Instead of drydocking the vessel during winter months, the vessel can be quickly transported to another geographic location and climate for year-round operation. The present invention is classifiable as an "oceanographic research vessel, subchapter "U" under the United States Code of Federal Regulations, and in calm seas can operate in shallow draft water down to five feet water depth.

Although the invention is described herein principally for the purpose of towing seismic energy sources or marine seismic streamers, the invention is adaptable to different marine seismic operations including the deployment of bottom cables and other techniques for generating and recording seismic data. The seismic vessel system provides unique flexibility in designing a data collection system to accommodate local water depths, land configuration, subsurface geology, and other environmental conditions.

The portable seismic vessel is truck transportable and can be selectively disassembled to reach remote survey sites. The vessel is assembled with multiple self-contained, autonomous modules. Different modules provide crew quarters, dining facilities, propulsion, fuel and equipment storage. The vessel is capable of storing and deploying acoustic energy sources, seismic streamers, and recording equipment for processing seismic data. The unique ballast system accommodates structural flexing of the vessel. The vessel is uniquely suitable to efficiently access previously inaccessible survey sites and provides design flexibility in customizing the seismic vessel to unique operating requirements.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A modular, portable seismic vessel for supporting marine seismic equipment, comprising:

a plurality of self-contained, autonomous modules, wherein at least one of said modules provides storage space for holding the marine seismic equipment and provides access to deploy and retrieve the marine seismic equipment from said module storage space;

connection means for retaining said modules in a configuration forming the seismic vessel;

propulsion means attached to at least one module for propelling the seismic vessel;

a controller engaged with said propulsion means for controlling movement of the vessel through the water; and handling means for deploying and retrieving the marine seismic equipment from said module storage space.

2. A seismic vessel as recited in claim 1, wherein at least one of said modules comprises crew quarters.

3. A seismic vessel as recited in claim 1, wherein the marine seismic equipment includes seismic streamers carrying seismic data gathering hydrophones, and wherein said handling means is capable of deploying and retrieving said seismic streamers.

4. A seismic vessel as recited in claim 3, further comprising recording equipment engaged with said hydrophones for collecting and recording the seismic data detected by said hydrophones.

5. A seismic vessel as recited in claim 3, further comprising an energy source for discharging acoustic energy into the water.

6. A modular, portable seismic vessel for supporting marine seismic equipment, comprising:

a plurality of self-contained, autonomous modules;

connection means for retaining said modules in a configuration forming the seismic vessel;

propulsion means attached to at least one module for propelling the seismic vessel;

a controller engaged with said propulsion means for controlling movement of the vessel through the water;

handling means for engaging the marine seismic equipment; and a ballast system for selectively redistributing ballast to selected locations on the seismic vessel, wherein said ballast system is capable of accommodating flexure of the seismic vessel.

7. A modular, portable seismic vessel for engaging marine seismic equipment, comprising:

a plurality of self-contained, autonomous modules each sized to be truck transportable, wherein at least one of said modules comprises crew quarters;

connection means for retaining said modules in a configuration forming the seismic vessel;

at least two propulsion means attached to separate modules for propelling the seismic vessel, wherein each propulsion means is capable of propelling the attached module through the water before the respective modules are assembled to form the seismic vessel, and wherein each propulsion means is separately operable to provide manueverability for the seismic vessel;

a controller engaged with said propulsion means for controlling movement of the vessel; and handling means for deploying and retrieving the marine seismic equipment.

8. A seismic vessel as recited in claim 7, further comprising steering means engaged with each propulsion means.

9. A seismic vessel as recited in claim 7, wherein said modules form a seismic vessel having a substantially open upper deck for permitting storage of the marine seismic equipment.

10. A seismic vessel as recited in claim 7, further comprising recording means engaged with the marine seismic equipment for recording seismic data.

11. A modular, portable seismic vessel for engaging marine seismic equipment, comprising:

a plurality of self-contained, autonomous modules each sized to be truck transportable, wherein at least one of said modules comprises crew quarters;

connection means for retaining said modules in a configuration forming the seismic vessel;

propulsion means attached to at least one module for propelling the seismic vessel;

a controller engaged with said propulsion means for controlling movement of the vessel;

handling means for deploying and retrieving the marine seismic equipment; and ballast means engaged between said modules for selectively redistributing ballast across the seismic vessel from one module to another.

12. A seismic vessel as recited in claim 11, wherein said ballast means is substantially located exterior of said modules.

* * * * *